US007041179B2

(12) United States Patent
Bronfin et al.

(10) Patent No.: US 7,041,179 B2
(45) Date of Patent: May 9, 2006

(54) HIGH STRENGTH CREEP RESISTANT MAGNESIUM ALLOYS

(75) Inventors: Boris Bronfin, Beer Sheva (IL); Eliyahu Aghion, Omer (IL); Frank Von Buch, Leiferde (DE); Soenke Schumann, Schwuelper (DE); Mark Katzir, Beer Sheva (IL)

(73) Assignees: Dead Sea Magnesium Ltd., (IL); Volkswagen AG, (DE)

( * ) Notice: Subject to any disclaimer, the term of this patent is extended or adjusted under 35 U.S.C. 154(b) by 70 days.

(21) Appl. No.: 10/038,414

(22) Filed: Jan. 3, 2002

(65) Prior Publication Data

US 2003/0084968 A1 May 8, 2003

(30) Foreign Application Priority Data

Nov. 5, 2001 (IL) ..... 146336

(51) Int. Cl.
*C22C 23/00* (2006.01)

(52) U.S. Cl. ..... 148/420; 420/407; 420/408; 420/409; 420/410

(58) Field of Classification Search ..... 148/420, 148/666, 667; 420/407–410
See application file for complete search history.

(56) References Cited

U.S. PATENT DOCUMENTS

| | | | |
|---|---|---|---|
| 6,139,651 | A | 10/2000 | Bronfin et al. |
| 2001/0055539 | A1* | 12/2001 | Nakamura et al. |

FOREIGN PATENT DOCUMENTS

| | | | |
|---|---|---|---|
| DE | 847992 | | 9/1960 |
| EP | 0 791 662 | | 8/1997 |
| EP | 0 799 901 | | 10/1997 |
| EP | 1 048 743 | | 11/2000 |
| EP | 1 108 799 | A2 | 6/2001 |
| EP | 1 127 950 | A1 | 8/2001 |
| EP | 1 108 799 | A3 | 11/2001 |
| GB | 596102 | | 12/1947 |
| GB | 2 296 256 | | 6/1996 |
| JP | 02047238 | * | 2/1990 |
| WO | WO 96/25529 | | 8/1996 |
| WO | 01/44529 | | 6/2001 |

OTHER PUBLICATIONS

XP-002202048 Creep Resistance in M-Al-Ca Casting Alloys, Magnesium Technology 2000, pp. 279 through 284.

* cited by examiner

*Primary Examiner*—Sikyin Ip
(74) *Attorney, Agent, or Firm*—Anderson Kill & Olick, PC

(57) ABSTRACT

A magnesium based alloy containing at least 85.4 wt % Mg, 4.7 to 7.3 wt % aluminum, 0.17 to 0.60 wt % manganese, 0.0 to 0.8 wt % zinc, 1.8 to 3.2 wt % calcium, 0.3 to 2.2 wt % tin, and 0.0 to 0.5 wt % strontium. The alloy may comprising up to 0.004 wt % iron, up to 0.001 wt % nickel, up to 0.003 wt % copper, or up to 0.03 wt % silicon. In addition, the alloy may comprise up to 0.001 wt % beryllium.

12 Claims, 9 Drawing Sheets

Table 1. Effect of aging (250°C for 1hr) on the mechanical properties of new alloys

| Alloy | State | TYS MPa | UTS MPa | E% | CYS MPa | MCR·$10^9$, $S^{-1}$ | | CR $mg/cm^2/day$ |
|---|---|---|---|---|---|---|---|---|
| | | | | | | 150°C 100 MPa | 200°C 55 MPa | |
| Example 3 | F | 183 | 237 | 4 | 183 | 0.84 | 1.05 | 1.58 |
| | T5 | 195 | 250 | 5 | 195 | 0.82 | 1.08 | 1.53 |
| Example 6 | F | 179 | 240 | 5 | 179 | 1.44 | 2.54 | 1.38 |
| | T5 | 200 | 255 | 5 | 198 | 1.28 | 2.35 | 1.41 |
| Example 8 | F | 188 | 236 | 5 | 186 | 1.05 | 1.95 | 1.35 |
| | T5 | 197 | 243 | 3 | 198 | 1.02 | 1.97 | 1.32 |
| Example 14 | F | 195 | 234 | 3 | 193 | 1.31 | 2.40 | 1.35 |
| | T5 | 203 | 250 | 3 | 202 | 1.18 | 2.28 | 1.37 |

Fig. 1

Table 2. Chemical Compositions of Alloys

| Alloy | Al % | Mn % | Zn % | Ca % | Sn % | Sr % | Si % | Fe % | Ni % | Cu % | Be % |
|---|---|---|---|---|---|---|---|---|---|---|---|
| Example 1 | 4.7 | 0.29 | - | 1.9 | 1.8 | 0.3 | 0.01 | 0.002 | 0.0006 | 0.0005 | - |
| Example 2 | 5.3 | 0.31 | 0.3 | 1.8 | 0.3 | - | 0.01 | 0.002 | 0.0005 | 0.0006 | 0.0005 |
| Example 3 | 5.1 | 0.30 | - | 2.9 | 1.0 | - | 0.01 | 0.003 | 0.0006 | 0.0006 | - |
| Example 4 | 4.9 | 0.30 | - | 2.0 | 2.0 | 0.3 | 0.01 | 0.003 | 0.0005 | 0.0005 | - |
| Example 5 | 5.2 | 0.31 | - | 3.1 | 0.5 | - | 0.01 | 0.002 | 0.0007 | 0.0004 | 0.0007 |
| Example 6 | 6.1 | 0.29 | 0.6 | 2.2 | 2.0 | - | 0.01 | 0.002 | 0.0006 | 0.0006 | - |
| Example 7 | 6.2 | 0.30 | - | 2.1 | 0.5 | 0.3 | 0.01 | 0.003 | 0.0006 | 0.0005 | - |
| Example 8 | 6.2 | 0.28 | - | 2.8 | 1.5 | - | 0.01 | 0.003 | 0.0007 | 0.0005 | - |
| Example 9 | 5.9 | 0.26 | - | 3.0 | 0.5 | 0.3 | 0.01 | 0.002 | 0.0005 | 0.0006 | - |
| Example 10 | 6.6 | 0.25 | - | 1.9 | 1.5 | 0.5 | 0.01 | 0.003 | 0.0006 | 0.0005 | - |
| Example 11 | 7.1 | 0.26 | - | 2.0 | 0.5 | - | 0.01 | 0.003 | 0.0006 | 0.0006 | - |
| Example 12 | 7.0 | 0.23 | 0.8 | 2.1 | 2.0 | - | 0.01 | 0.002 | 0.0005 | 0.0005 | - |
| Example 13 | 7.3 | 0.24 | - | 3.1 | 0.7 | - | 0.01 | 0.003 | 0.0006 | 0.0005 | 0.0004 |
| Example 14 | 7.1 | 0.21 | 0.7 | 3.0 | 1.1 | - | 0.01 | 0.002 | 0.0005 | 0.0005 | - |
| Comparative Example 1 | 8.9 | 0.23 | 0.74 | - | - | - | 0.01 | 0.002 | 0.0007 | 0.0009 | 0.0009 |
| Comparative Example 2 | 4.3 | 0.29 | 0.01 | 2.4% RE | - | - | 0.01 | 0.002 | 0.0008 | 0.0008 | 0.0008 |
| Comparative Example 3 | 4.1 | 0.34 | - | 1.5 | - | 0.10 | 0.01 | 0.002 | 0.0005 | 0.0007 | 0.0009 |
| Comparative Example 4 | 5.5 | 0.31 | - | 2.7 | - | 0.15 | 0.01 | 0.003 | 0.0006 | 0.0008 | 0.0008 |
| Comparative Example 5 | 7.9 | 0.24 | 0.7 | 2.2 | 1.0 | - | 0.01 | 0.003 | 0.0008 | 0.0007 | - |

Fig. 2

Table 3. Die castability properties of new alloys

| Alloy | Metal temperature [°C] | Oxidation resistance | Fluidity | Die sticking | Rank |
|---|---|---|---|---|---|
| Example 1 | 670 | 10 | 9 | 9 | 91.7 |
| Example 2 | 690 | 10 | 10 | 8 | 86.7 |
| Example 3 | 675 | 10 | 9 | 8 | 85.1 |
| Example 4 | 680 | 10 | 10 | 9 | 93.3 |
| Example 5 | 670 | 10 | 9 | 9 | 91.7 |
| Example 6 | 670 | 10 | 9 | 10 | 98.4 |
| Example 7 | 660 | 10 | 9 | 9 | 91.7 |
| Example 8 | 660 | 10 | 9 | 9 | 91.7 |
| Example 9 | 670 | 10 | 10 | 9 | 93.3 |
| Example 10 | 675 | 10 | 10 | 9 | 93.3 |
| Example 11 | 660 | 10 | 10 | 9 | 93.3 |
| Example 12 | 660 | 10 | 10 | 10 | 100 |
| Example 13 | 660 | 10 | 10 | 9 | 93.3 |
| Example 14 | 660 | 10 | 10 | 9 | 93.3 |
| Comparative Example 1 | 670 | 9 | 10 | 10 | 98.4 |
| Comparative Example 2 | 690 | 8 | 8 | 9 | 80 |
| Comparative Example 3 | 690 | 10 | 8 | 5 | 60 |
| Comparative Example 4 | 675 | 10 | 9 | 7 | 78.3 |
| Comparative Example 5 | 660 | 10 | 10 | 9 | 93.3 |

Fig. 3

Table 4. Intermetallic Phases in New Alloys

| Alloy | Phase composition |
|---|---|
| Example 1 | Mg-Al-$Sn_{ss}$, $Al_2Ca$, $Al_2(Ca,Sn)$, $Al_2(Ca,Sr)$, $Al_2(Ca,Sn,Sr)$, $Al_{0.54}Mn_{0.06}$ |
| Example 2 | Mg-$Al_{ss}$, $Al_2Ca$, $Al_2(Ca,Sn)$, $Al_{0.56}Mn_{0.44}$ |
| Example 3 | Mg-Al-$Sn_{ss}$, $Al_2Ca$, $Al_2(Ca,Sn)$, $Al_{0.55}Mn_{0.45}$ |
| Example 4 | Mg-Al-$Sn_{ss}$, $Al_2Ca$, $Al_2(Ca,Sn)$, $Al_2(Ca,Sr)$, $Al_2(Ca,Sn,Sr)$, $Al_{0.53}Mn_{0.47}$ |
| Example 5 | Mg-$Al_{ss}$, $Al_2Ca$, $Al_2(Ca,Sn)$, $Al_{0.58}Mn_{.42}$ |
| Example 6 | Mg-Al-Zn-$Sn_{ss}$, $Al_2Ca$, $Al_2(Ca,Sn)$, $Al_{0.61}Mn_{0.39}$ |
| Example 7 | Mg-$Al_{ss}$, $Al_2Ca$, $Al_2(Ca,Sr)$, $Al_2(Ca,Sn)$, $Al_2(Ca,Sn,Sr)$, $Al_{0.59}Mn_{0.41}$ |
| Example 8 | Mg-Al-$Sn_{ss}$, $Al_2Ca$, $Al_2(Ca,Sn)$, $Al_{0.63}Mn_{0.37}$ |
| Example 9 | Mg-$Al_{ss}$, $Al_2Ca$, $Al_2(Ca,Sn)$, $Al_2(Ca,Sr)$, Al2(Ca,Sn,Sr), $Al_{0.62}Mn_{0.38}$ |
| Example 10 | Mg-Al-$Sn_{ss}$, $Al_2Ca$, $Al_2(Ca,Sr)$, $Al_2(Ca,Sn,Sr)$ |
| Example 11 | Mg-$Al_{ss}$, $Al_2Ca$, $Al_2(Ca,Sn)$, $Al_{0.64}Mn_{0.36}$ |
| Example 12 | Mg-Al-Zn-$Sn_{ss}$, $Al_2Ca$, $Al_2(Ca,Sn)$, $Al_{0.65}Mn_{0.35}$ |
| Example 13 | Mg-Al-$Sn_{ss}$, $Al_2Ca$, $Al_2(Ca,Sn)$, $Al_{0.62}Mn_{0.38}$ |
| Example 14 | Mg-Al-$Sn_{ss}$, $Al_2Ca$, $Al_2(Ca,Sn)$, $Al_{0.64}Mn_{0.36}$ |
| Comparative example 1 | Mg-$Al_{ss}$, $Mg_{17}(Al,Zn)_{12}$, $Al_8Mn_5$ |
| Comparative example 2 | Mg-$Al_{ss}$, $Al_{11}RE_3$, $Al_{10}RE_2Mn_7$ |
| Comparative example 3 | Mg-$Al_{ss}$, $Al_2Ca$, $Al_2(Ca,Sr)$, $Al_{0.58}Mn_{0.42}$ |
| Comparative example 4 | Mg-$Al_{ss}$, $Al_2Ca$, $Al_2(Ca,Sr)$, $Al_{0.54}Mn_{0.46}$ |
| Comparative example 5 | Mg-Al-Sn-$Zn_{ss}$, $Al_2Ca$, $Al_2(Ca,Sn)$ |

Fig. 4

Table 5. Mechanical Properties and Creep Behavior

| Alloy | TYS Mpa | | | UTS MPa | E % | CYS MPa | | | MCR·$10^9$, $S^{-1}$ | | CR $mg/cm^2/day$ |
|---|---|---|---|---|---|---|---|---|---|---|---|
| | 20°C | 175°C | 200°C | 20°C | 20°C | 20°C | 175°C | 200°C | 150°C, 100 MPa | 200°C, 55 MPa | |
| Example 1 | 175 | 160 | 145 | 227 | 5 | 172 | 155 | 143 | 1.30 | 1.96 | 1.52 |
| Example 2 | 172 | 158 | 142 | 235 | 5 | 175 | 159 | 146 | 1.25 | 1.85 | 1.50 |
| Example 3 | 183 | 165 | 154 | 237 | 4 | 183 | 165 | 155 | 0.84 | 1.05 | 1.58 |
| Example 4 | 170 | 161 | 142 | 236 | 6 | 171 | 160 | 143 | 1.05 | 1.40 | 1.48 |
| Example 5 | 180 | 168 | 152 | 235 | 4 | 179 | 168 | 153 | 0.80 | 1.08 | 1.56 |
| Example 6 | 179 | 165 | 145 | 240 | 5 | 179 | 164 | 147 | 1.44 | 2.54 | 1.38 |
| Example 7 | 178 | 163 | 148 | 238 | 5 | 176 | 163 | 146 | 1.39 | 2.44 | 1.45 |
| Example 8 | 188 | 170 | 155 | 236 | 5 | 186 | 169 | 155 | 1.05 | 1.95 | 1.37 |
| Example 9 | 186 | 172 | 157 | 232 | 4 | 186 | 172 | 157 | 0.95 | 1.88 | 1.49 |
| Example 10 | 179 | 162 | 145 | 250 | 5 | 180 | 160 | 146 | 1.65 | 4.50 | 1.54 |
| Example 11 | 180 | 160 | 143 | 248 | 5 | 179 | 160 | 142 | 1.64 | 4.80 | 1.32 |
| Example 12 | 183 | 165 | 145 | 245 | 4 | 185 | 163 | 144 | 1.59 | 4.55 | 1.45 |
| Example 13 | 196 | 170 | 158 | 230 | 3 | 192 | 170 | 157 | 1.25 | 2.25 | 1.47 |
| Example 14 | 195 | 174 | 160 | 234 | 3 | 193 | 173 | 161 | 1.31 | 2.40 | 1.32 |
| Comparative Example 1 | 160 | 88 | 75 | 260 | 6 | 158 | 86 | 75 | 1426 | 2890 | 1.31 |
| Comparative Example 2 | 135 | 88 | 85 | 240 | 12 | 136 | 90 | 86 | 784 | 463 | 1.62 |
| Comparative Example 3 | 160 | 148 | 138 | 225 | 3 | 155 | 147 | 136 | 1.82 | 4.72 | 1.59 |
| Comparative Example 4 | 179 | 160 | 145 | 220 | 3 | 178 | 161 | 144 | 0.87 | 1.67 | 1.47 |
| Comparative Example 5 | 195 | 168 | 153 | 230 | 1 | 192 | 165 | 150 | 1.75 | 5.6 | 1.39 |

Fig. 5

HIGH STRENGTH CREEP RESISTANT MAGNESIUM ALLOYS

FIELD OF THE INVENTION

The present invention relates to high strength magnesium-based alloys with good creep resistance, which are suitable for high temperature applications, even at 175–200° C.

BACKGROUND OF THE INVENTION

Magnesium alloys, being one third lighter than an equal volume of aluminum, are the lightest structural material in the car industry. The vehicle weight and fuel economy are becoming increasingly important in the automotive industry. The European and North American car producers have committed to reduce the fuel consumption by 25% and thereby to achieve 30% reduction of the $CO_2$ emissions by the year 2010. Accordingly, the said alloys are becoming still more attractive.

Most of the drive train components are produced by high-pressure die casting. This technique has probably the greatest production volume among procedures employing magnesium alloys, and it seems to remain so even in future. However, also other techniques are used, including sand casting and permanent mold casting, squeeze casting, semi-solid casting, thixocasting and thixomolding.

The cost of an alloy represents a significant proportion of the total component cost, becoming an important factor in the development of new alloys. An ideal magnesium alloy for making automobile parts, beside being cost effective, should meet several conditions related to its behavior during the casting process and during its use under continued stress. The good castability includes good flow of melted alloy into thin mold sections, low sticking of the melted alloy to the mold, and resistance to oxidation during the casting process. A good alloy should not develop cracks during cooling and solidifying stage of casting. The parts that are cast of the alloy should have high tensile and compressive yield strength, and during their usage they should show a low continued strain under stress at elevated temperature (creep resistance). The good mechanical properties should be kept even at temperatures higher than 120° C., if the parts are intended as parts of the gear box of a crankcase. However, some drive train components, such as engine block, oil pan, intake manifold, lower crankcase, oil pump housing and others, should withstand even higher temperatures. Improved creep resistance and stress relaxation properties are a critical issue for the alloy to be used for manufacturing such components. The alloy should also be resistant to the corrosion. The physical and chemical properties of the alloy depend in a substantial way on the presence of other metallic elements which can form a variety of intermetallic compounds. These intermetalic compounds impede grain sliding under stress at elevated temperatures.

One of procedures known in the art for improving stability of a metallic mixture is a type of heat treatment, called ageing, which can affect the microstructure of the metal. However, the existing commercial die cast magnesium alloys do not exhibit a marked response to ageing.

All conventional die casting magnesium alloys are based on Mg—Al system. The alloys of the Mg—Al—Zn system (e.g., commercially available alloy AZ91D) or of Mg—Al—Mn system have good castability, corrosion resistance and combination of ambient strength and ductility, however they exhibit poor creep resistance and poor elevated-temperature strength. On the other hand, Mg—Al—Si alloys and Mg—Al—RE alloys have better creep resistance but exhibit insufficient corrosion resistance (AS41 and AS21 alloys) and poor castability (AS21 and AE42 alloys). Both types of alloys further exhibit relatively low tensile yield strength at ambient temperatures. In addition, high content of RE elements, e.g. 2.4% in AE42, increases the costs.

The introduction of other alloying elements in the alloy may overcome some of the mentioned drawbacks. German Patent Specification No 847,992 describes magnesium-based alloys, which contain up to 3 wt % calcium, showing a creep strain of less than 0.2% under an applied stress of 30 MPa at 200° C. for 50 hours. GB 2,296,256 discloses a magnesium-based alloy containing up to 2 wt % RE and up to 5.5 wt % Ca, claiming the creep rate of 0.01% per 50 hours. WO 9625529 discloses a magnesium-based alloy containing up to 0.8 wt % calcium which has a creep strain of less than 0.5% under an applied stress of 35 MPa at 150° C. for 200 hours. EP 799901 describes a magnesium-based alloy for semi-solid casting which contains up to 4 wt % calcium and up to 0.15 wt % strontium, wherein the ratio Ca/Al should be less than 0.8. EP 791662 discloses magnesium-based alloy comprising up to 3 wt % Ca and up to 3 wt % of RE elements, wherein the alloys are die-castable only for certain ratios of the elements, claiming enhanced strength at higher temperatures. EP 1048743 teaches a method for making a magnesium alloy for casting, comprising Ca up to 3.3% and Sr up to 0.2%, claiming an improved creep resistance at 150–175° C. WO 01/44529 claims an alloy for die-casting which contains up to 7% strontium, and which has a creep deformation of 0.06% at 150° C. U.S. Pat. No. 6,139,651 discloses a magnesium-based alloy comprising Ca up to 1.2 wt %, Sr up to 0.2 wt %, RE elements up to 1 wt %, beryllium up to 0.0015 wt %, while Zn is in one of the ranges 0.01 to 1 wt %, and 5 to 10 wt %. This alloy exhibits excellent castability, corrosion resistance and mechanical properties, and is designated for applications with operating temperature up to 150° C. However, in order to expand magnesium applications to crankcase and engine blocks operating at temperatures higher than 150° C., still more enhanced resistance of the alloys is required. It is therefore an object of this invention to provide magnesium alloys capable of operating at temperatures as high as 175–200° C. This invention aims at providing alloys with improved strength at ambient and elevated temperatures, as well as improved creep resistance at elevated temperatures up to the temperatures in the range of 175–200° C.

It is another object of this invention to provide alloys, which are particularly well adapted for high pressure die-casting process, exhibiting reduced susceptibility to die sticking, oxidation, and hot cracking, and which have good fluidity.

It is still another object of this invention to provide magnesium-based alloys suitable for elevated temperature applications which have a good corrosion resistance.

It is a further object of this invention to provide alloys, which may also be used for other applications such as, sand casting, permanent mold casting, squeeze casting, semi-solid casting, thixocasting and thixomolding.

It is a still further object of this invention to provide alloys, which can be successfully cast though being beryllium free.

This invention also aims at providing alloys that exhibit improvements of their strength in course of ageing.

It is also an object of this invention to provide alloys, which exhibit the aforesaid behavior and properties and have a relatively low cost.

Other objects and advantages of present invention will appear as description proceeds.

SUMMARY OF THE INVENTION

The present invention relates to high strength magnesium-based alloys with good creep resistance, which are suitable for applications at elevated temperatures, even at 175–200° C. The alloys according to the invention have good castability and exhibit good corrosion resistance. Said alloys comprise aluminum, manganese, zinc, calcium, tin, strontium, and beryllium. The alloys of this invention contain at least 85.4 wt % Mg, 4.5 to 7.5 wt % aluminum, 0.17 to 0.6 wt % manganese, 0.0 to 0.8 wt % zinc, 1.8 to 3.2 wt % calcium, 0.3 to 2.2 wt % tin, 0.0 to 0.5 wt % strontium, and 0.000 to 0.001 wt % beryllium. The content of iron, nickel, copper, and silicone in the alloy is not higher than 0.004 wt %, 0.001 wt %, 0.003 wt %, and 0.03 wt %, respectively.

The micro-structure of an alloy according to this invention comprises Mg—Al solid solution or Mg—Al—Sn solid solution as a matrix and the intermetallic phases precipitated at grain boundaries of the Mg—Al or Mg—Al—Sn matrix. The intermetallic compounds presented in the alloys of the present invention are $Al_2Ca$, $Al_2(Ca, Sr)$, $Al_2(Ca, Sn)$, $Al_2(Ca, Sn, Sr)$, $Al_xMn_y$, wherein the "x" to "y" ratio depends on the aluminum content in the alloy.

The alloys of this invention are particularly useful for high-pressure die casting applications due to reduced susceptibility to hot cracking and die sticking. The invention also relates to alloys that can be used in other processes, comprising sand casting, permanent mold casting, squeeze casting, semi-solid casting, thixocasting and thixomolding.

The invention further relates to articles produced by casting a magnesium-based alloy having the composition defined hereinbefore, which alloy exhibits high strength, good creep resistance and castability, is suitable for elevated temperature applications, and has good corrosion resistance.

BRIEF DESCRIPTION OF THE DRAWINGS

The above and other characteristics and advantages of the invention will be more readily apparent through the following examples, and with reference to the appended drawings, wherein:

FIG. 1 is Table 1, showing chemical compositions of alloys;

FIG. 2 is Table 2, showing the castability properties of new alloys;

FIG. 3 is Table 3, showing intermetallic phases in new alloys;

FIG. 4 is Table 4, showing the mechanical properties and creep behavior of alloys;

FIG. 5 is Table 5, showing the effect of aging on mechanical properties of alloys;

DETAILED DESCRIPTION OF THE INVENTION

Figure 6A:
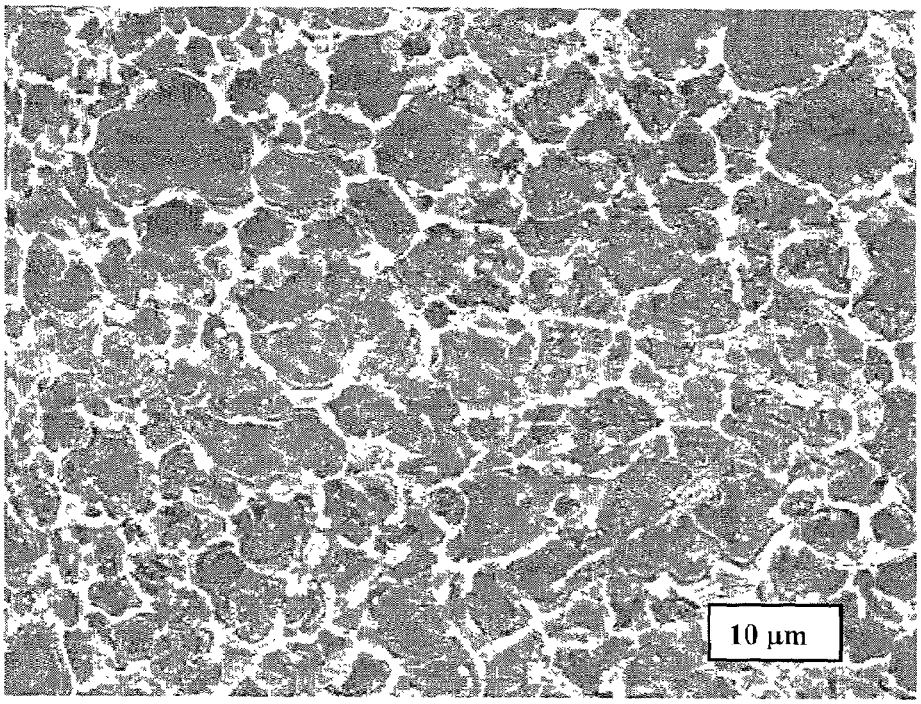
FIGS. 6, A and B, show the microstructures of a die cast alloy according to Examples 1 and 3, respectively.

It has now been found that certain combinations of elements in magnesium based alloys, comprising aluminum, manganese, zinc, calcium, strontium, and tin, lead to properties superior to those of the prior art alloys. These properties include excellent high tensile yield and compressive yield strength at ambient and elevated temperatures, even at 175° C. to 200° C., excellent creep resistance in the temperature range from 150 to 200° C., good castability and corrosion resistance, noticeable response to low temperature ageing, and molten metal behavior. The new alloys exhibit a marked response to ageing at 250° C., wherein tensile yield strength, compressive yield strength, and creep resistance increase.

A magnesium-based alloy of the present invention comprises 4.7 to 7.3 wt % Al. If the aluminum concentration is lower than 4.7 wt %, the alloy will not exhibit good fluidity properties and castability. On the other hand the aluminum concentration higher than 7.3 wt % leads to embrittlement and deterioration of creep resistance. An alloy of the present invention contains calcium from 1.8 to 3.2 wt %. The presence of calcium in this range of concentrations considerably improves creep resistance and enables preparing and die casting alloys with reduced consumption of protective gases, particularly $SF_6$, even for beryllium free alloys. A calcium concentration lower than 1.8 wt % does not ensure sufficient creep resistance. On the other hand, the calcium concentration should not exceed 3.2 wt % to avoid embrittlement. One of essential features of the alloys according to the present invention is the presence of tin to improve castability. It was found that the presence of tin at a concentration at least 0.3 wt % markedly improved castability, and eliminated sticking to die. Tin additions higher than 2.2% lead to a decrease in the alloy strength. The alloys of the present invention contain manganese in order to reduce iron and improve corrosion resistance. The manganese content depends on the aluminum content and may vary from 0.17 to 0.6 wt %. The alloys of the present invention may contain strontium up to 0.5 wt % to modify the intermetallic phases and further improve creep resistance. Increasing the strontium concentration above 0.5% does not substantially improve creep resistance, while unnecessarily increasing the cost. The alloys of this invention may contain zinc up to 0.8% in order to improve castability and strength at the ambient temperature. More than 0.8 wt % zinc can cause hot cracking.

The alloys of this invention may contain a minor amount of beryllium, up to 0.001 wt %. However, an important feature of alloys of this invention is that they can be successfully prepared and cast as beryllium free. It is an advantage since beryllium is classified as a toxic metal.

Silicon is a typical impurity, which is present in the magnesium that is used for magnesium alloy preparation. Hence, a magnesium alloy may contain silicon, however the silicon content should not exceed 0.03 wt %. It is known that iron, nickel and copper dramatically reduce the corrosion resistance of magnesium alloys. Therefore, the alloys of the present invention do not contain more than 0.004 wt % iron, not more than 0.001 wt % nickel, and not more than 0.003 wt % copper.

In a preferred embodiment of the present invention, a magnesium based alloy contains 5.9 to 7.2 wt % aluminum, 0.9 to 2.1 wt % tin, 2.1 to 3.1 wt % calcium, and 0.2 to 0.3 wt % manganese.

It was found that the addition of calcium, tin and strontium in the weight percentage set forth herein leads to the precipitation of several intermetallic compounds. In a strontium-free alloy of this invention, intermetallic compounds $Al_2Ca$, $Al_2(Ca,Sn)$ and $Al_xMn_y$ can be detected at grain boundaries of the Mg—Al solid solution. In a strontium-containing alloy of this invention, microstructure comprise Mg—Al solid solution with precipitates located at grain boundaries, comprising intermetallic compounds $Al_2Ca$, $Al_2(Ca,Sn)$, $Al_2(Ca,Sr)$, $Al_2(Ca, Sr, Sn)$ and $Al_xMn_y$. The ratio x to y depends on the aluminum concentration in an alloy.

The magnesium alloys of the present invention have been tested and compared with comparative samples, including largely used, commercially available, magnesium alloys AZ91D and AE42. Metallography examination by scanning electron microscopy, and X-ray diffraction analysis of the precipitates showed distinct differences between comparative samples and alloys according to the present invention, for example, in the formation of new intermetallic precipitates. The microstructure of the new alloys, for example, consisted of fine grains of Mg—Al solid solution and eutectic phases located at grain boundaries. These phases, containing Al, Ca, Sr and Sn, have high melting points and impede grain sliding under high temperature loading.

Castability was evaluated by combining three parameters that characterize alloy behavior during the casting process: fluidity, sticking to the die, and oxidation resistance. Of all the comparative samples, only AZ91D alloy had similar castability as the alloys of the present invention, of which casting behavior was considerably better than that of AE42 alloy.

Tensile and compression testing revealed that the alloys of the present invention exhibit lower elongation at ambient temperature, and significantly higher tensile yield strength (TYS) and compressive yield strength (CYS) both at ambient temperature and at 175° C., and even at 200° C.

Corrosion resistance of the new alloys, as measured by immersion in NaCl solution followed by stripping in chromic acid, was in the range set by resistance of alloys AZ91D and AE42.

Creep behavior was measured at 150° C. and 200° C. for 200 hrs under a stress of 100 MPa and 55 MPa respectively. The selection of the conditions is based on requirements for power train components like crankcase, oil pan, intake manifolds etc. Creep resistance was characterized by the value of the minimum creep rate, which is considered as the most important design parameter for power train components. The alloys of the present invention had much higher creep resistance than the alloys AZ91D and AE42, the ratio between resistance values reaching the magnitude of three orders.

The alloys of the invention were subjected to ageing at 250° C. for 1 hr. It was found that the alloys underwent significant precipitation hardening by this treatment, which led to the improvement of all mechanical parameters, without influencing the corrosion rate. This potential renders the alloys of this invention a great technological advantage, since existing commercial die cast magnesium alloys do not exhibit a marked response to ageing. For example, low temperature ageing could be combined with other technology processes, such as applying various paint systems, etc.

In a preferred embodiment, an article made of an alloy according to the present invention is high-pressure die cast.

In other embodiments of this invention, an article made of an alloy according to the present invention is cast by a procedure chosen among sand casting, permanent mold casting squeeze casting, semi-solid casting, thixocasting and thixomolding.

Based on the above findings, the present invention is also directed to the articles made of magnesium alloys components, said articles having improved strength, and creep resistance at ambient temperatures and at elevated temperatures, as well as a good corrosion resistance, wherein said articles are used as parts of automotive or aerospace construction systems.

Specifically, the present invention relates to articles which exhibit tensile yield strength at ambient temperature higher than 170 MPa and tensile yield strength at 175° C. higher than 150 Mpa; articles which exhibit minimum creep rate (MCR) less than $1.7\times10^{-9}$/s at 150° C. under stress of 100 Mpa; articles which exhibit minimum creep rate less than 4.9×10−9/s at 200° C. under stress of 55 Mpa; and articles which were subjected to temperature ageing at 250° C. for 1 hour.

The invention will be further described and illustrated in the following examples.

EXAMPLE

General Procedures

The alloys of the present invention were prepared in 100 liter crucible made of low carbon steel. The mixture of $CO_2$+0.5%$SF_6$ was used as a protective atmosphere. The raw materials used were as follows:

Magnesium—pure magnesium, grade 9980A, containing at least 99.8% Mg.

Manganese—an Al-60% Mn master alloy that was added into the molten magnesium at a melting temperature from 700° C. to 720° C., depending on the manganese concentration. Special preparation of the charged pieces and intensive stirring of the melt for 15–30 min have been used to accelerate manganese dissolution in the molten magnesium.

Aluminum—commercially pure Al (less than 0.2% impurities).

Tin—commercially pure Sn (less than 0.25% impurities).

Calcium—a master alloy Al-75% Ca.

Strontium—a master alloy Al-90% Sr.

Zinc—commercially pure Zn (less than 0.1% impurities).

Typical temperatures for introducing Al, Ca, Sr, Sn, and Zn were from 690° C. to 710° C. Intensive stirring for 2–15 min was sufficient for dissolving these elements in the molten magnesium.

Beryllium—the additions of 5–10 ppm of beryllium were introduced in some of the new alloys in the form of a master alloy Al-1% Be, after tempering the melt at temperatures of 660–690° C. prior to casting. However, most of the new alloys were prepared and cast as Be free.

After preparing the required compositions, the alloys were cast into 8 kg ingots. The casting was carried out without any protection of the molten metal during solidification in the molds. Neither burning nor oxidation was observed on the surface of all the experimental ingots. Chemical analysis was performed using spark emission spectrometer. The die casting trials were performed using an IDRA OL-320 cold chamber die casting machine with a 345 ton locking force. The die used for producing test samples was a six cavity mold producing:

two round specimens for tensile test as per ASTM Standard B557M-94, one sample suitable for creep testing, one sample suitable for fatigue testing, one ASTM E23 standard impact test sample, one round sample with diameter of 10 mm for immersion corrosion test as per ASTM G31 standard.

The die castability was evaluated during die casting trials by observing fluidity (F), oxidation resistance (OR) and die sticking (D). Each alloy was rated, according to increasing quality, from 1 to 10 with regard to the three properties. The combined "castability factor" (CF) was calculated by weighing the tree parameters, wherein die sticking had weight factor 4, and fluidity with oxidation had each weight factor 1:

$$CF = \left[\frac{T}{670} \cdot OR + \frac{670}{T} \cdot F + 4D\right]\frac{100}{60}$$

where T is actual casting temperature, and 670 is the casting temperature for AZ91D alloy [° C.].

Metallography examination was performed using an optical microscope and scanning electron microscope (SEM) equipped with an energy dispersive spectrometer (EDS). The phase compositions were determined using X-Ray diffraction analysis combined with EDS analysis.

Tensile and compression testing at ambient and elevated temperatures were performed using an Instron 4483 machine equipped with an elevated temperature chamber. Tensile yield strength (TYS), ultimate tensile strength (UTS) and percent elongation (% E), and compression yield strength (CYS) were determined.

The SATEC Model M-3 machine was used for creep testing. Creep tests were performed at 150° C. and 200° C. for 200 hrs under a stress of 100 MPa and 55 MPa respectively. The selection of the conditions was based on creep behavior requirements for power train components like crankcase, oil pan, intake manifolds etc. Creep resistance was characterized by the value of the minimum creep rate (MCR), which is considered as the most important design parameter for power train components.

The corrosion behavior was evaluated using the immersion corrosion test according to ASTM Standard G31-87. The tested samples, cylindrical rods 100 mm long and 10 mm in diameter, were degreased in acetone and then immersed in 5% NaCl solution at ambient conditions, 23±1° C., for 72 hours.

Five replicates of each alloy were tested. The samples were then stripped of the corrosion products in a chromic acid solution (180 g $CrO_3$ per liter solution) at 80° C. for about three minutes. The weight loss was determined, and used to calculate the average corrosion rate in mg/cm$^2$/day.

Examples of Alloys

Tables 1 to 5 illustrate chemical compositions and properties of alloys according to the invention and alloys of comparative examples. Table 1 shows chemical compositions of 14 new alloys along with five comparative examples. The comparative examples 1 and 2 are the commercial magnesium alloys AZ91D and AE42, respectively.

Figure 6B:
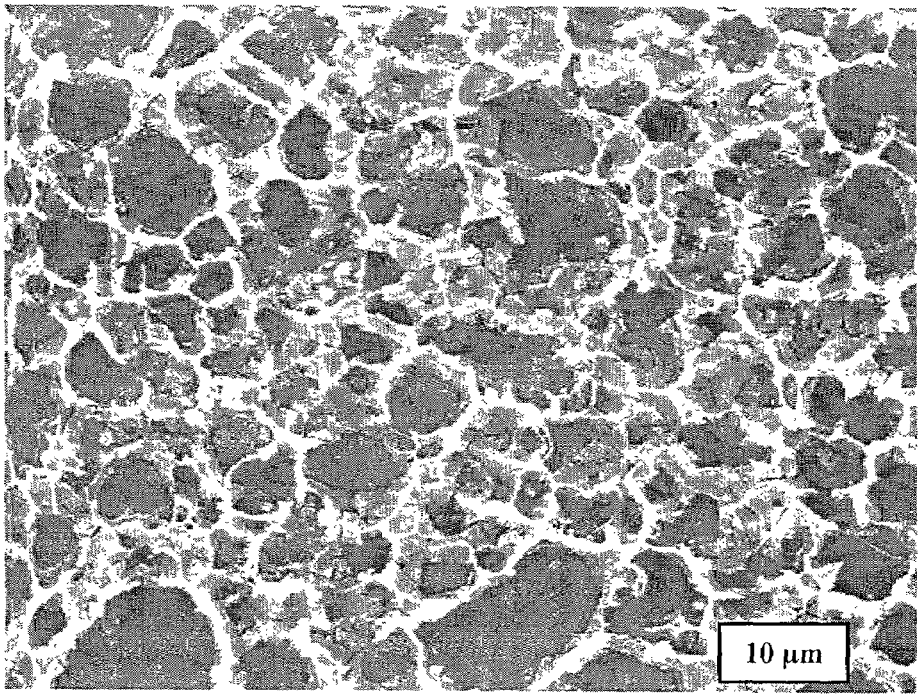
Figure 7A:
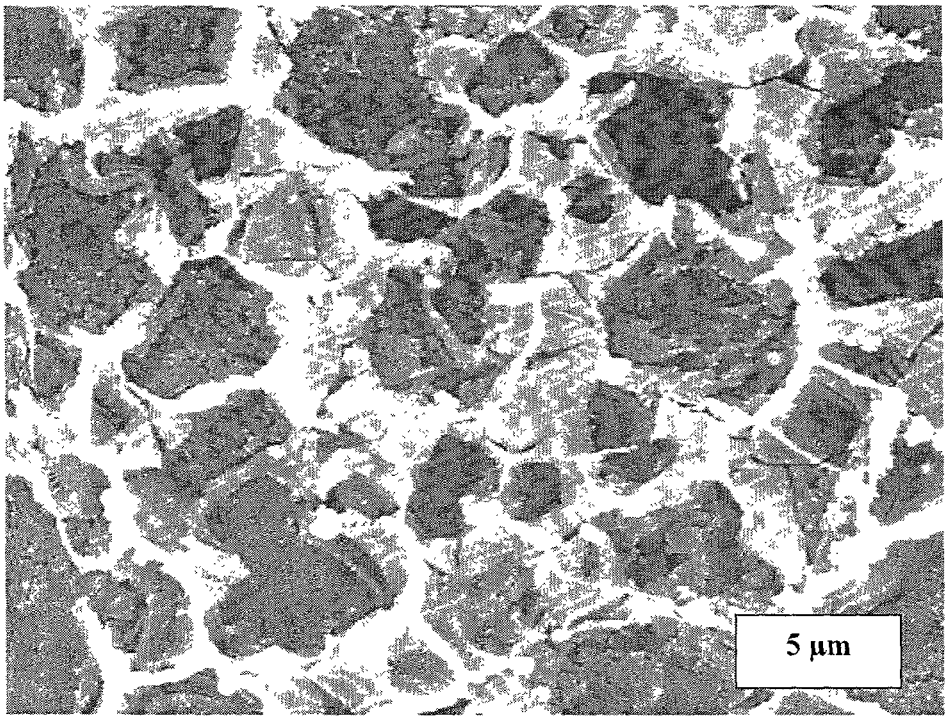
FIGS. 7, A and B, show the microstructures of a die cast alloy according to Examples 5 and 7, respectively.
Figure 7B:
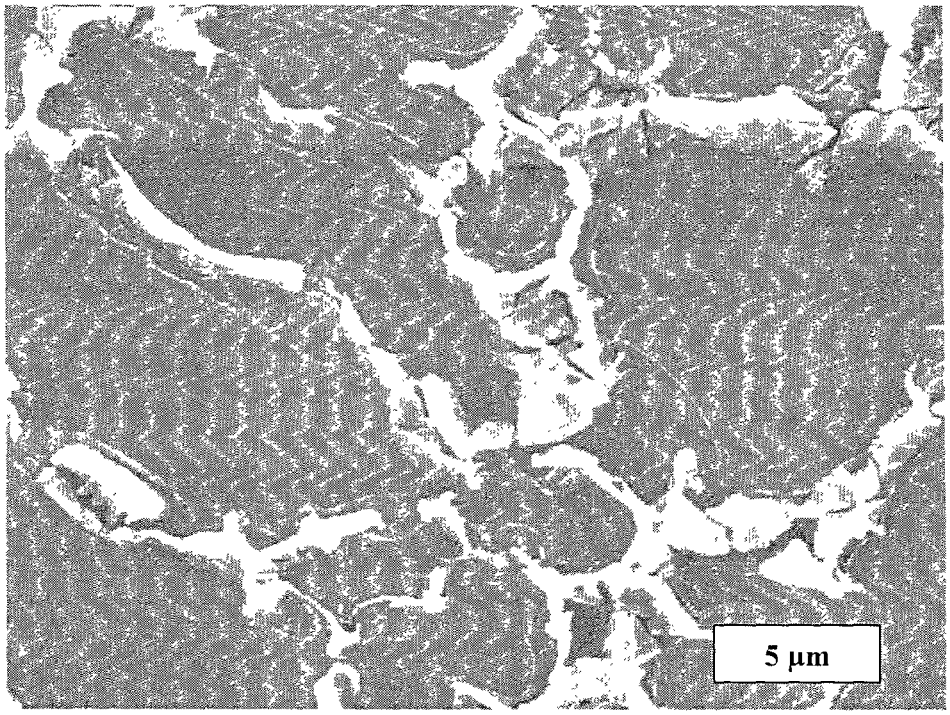
Figure 8A:
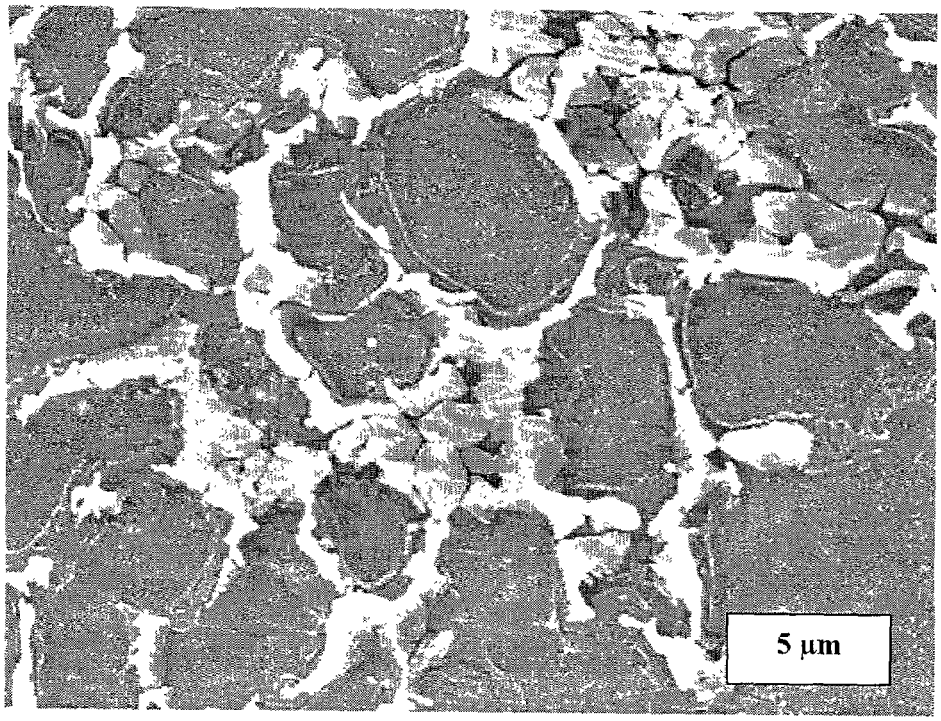
FIGS. 8 A and B, show the microstructures of a die cast alloy according to Examples 10 and 12, respectively.
Figure 8B:
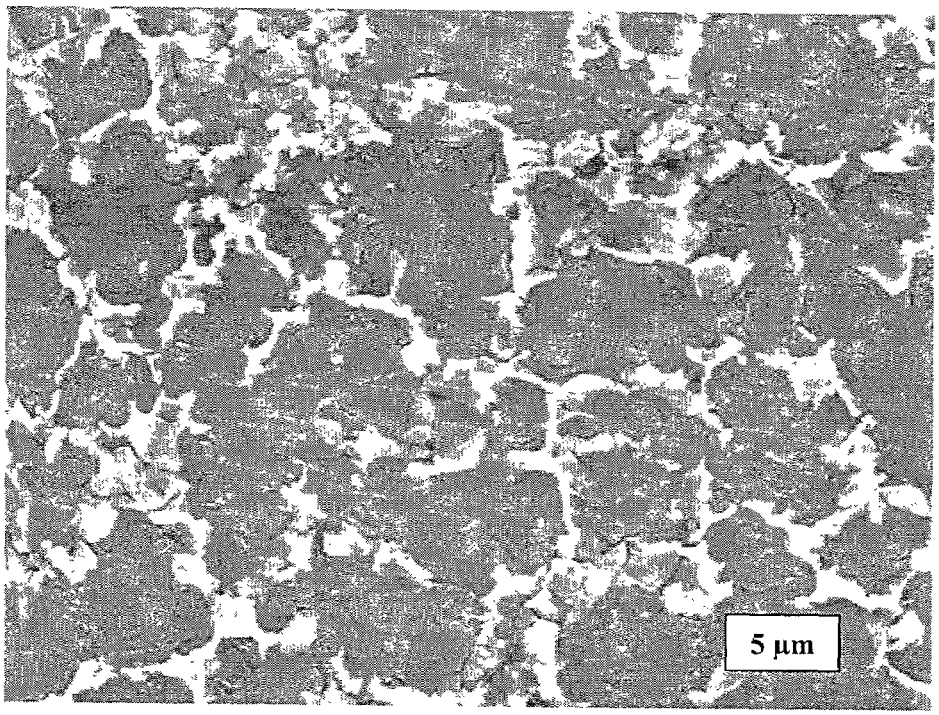
Figure 9A:
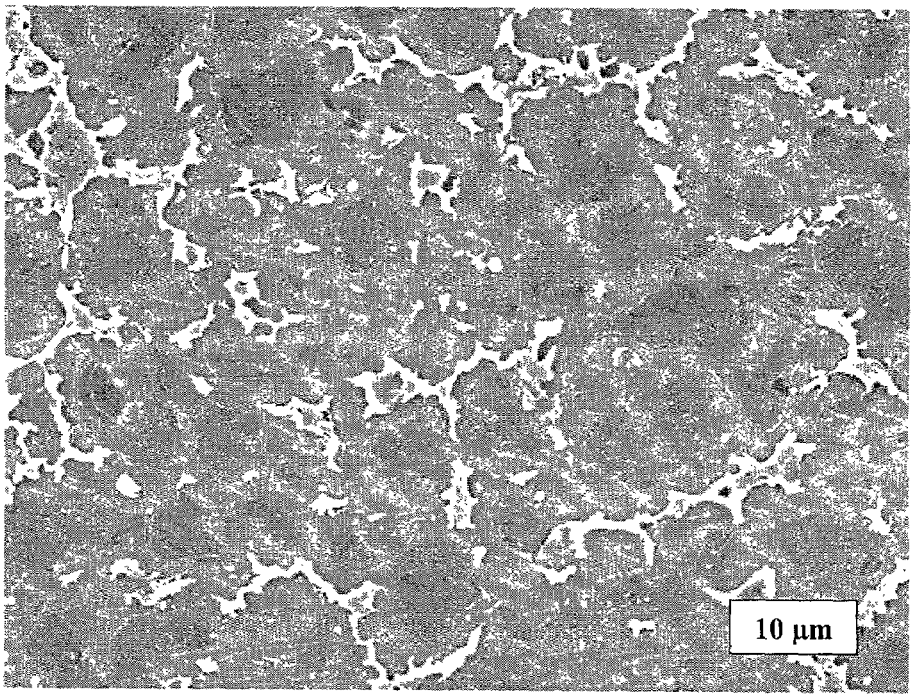
FIGS. 9 A and B, show the microstructures of a die cast alloys AZ91D (Comparative Example 1) and AE42 (Comparative Example 2), respectively.
Figure 9B:
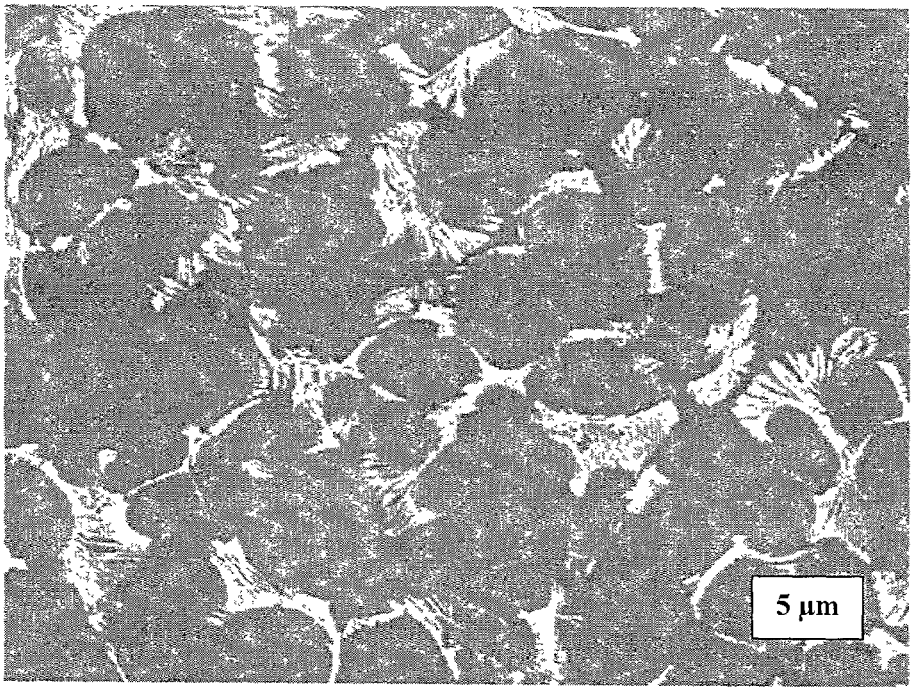

The results of the metallography examination of the new alloys and comparative examples 1 and 2 are shown in FIGS. 6–9. The micrographs reveal extremely fine grains of Mg—Al solid solution or Mg—Al—Sn solid solution surrounded by a grain boundary eutectic precipitates. These phases were identified using an X-Ray diffraction analysis and EDS analysis. The results obtained are summarized in Table 3 along with data obtained for comparative alloys. The table shows that alloying with aluminum, calcium, tin, strontium, manganese and zinc in the weight percentages set forth herein results in the formation of new intermetallic phases, which are different from the intermetallic compounds that are present in AZ91D and AE42 alloys.

Die castability properties of new alloys are given in Table 2. It is evident that new alloys of the instant invention exhibit a die castability considerably better than AE42 alloy (Comparative Example 2). The Comparative Examples 3 to 5 demonstrate that an addition of tin significantly reduces the tendency of sticking in die for Mg—Al—Ca alloys.

The tensile, compression and creep properties as well as corrosion resistance of new alloys are given in Table 4. The results show that new alloys of the present invention exhibit tensile yield strength (TYS) and Compression yield strength (CYS) considerably higher than conventional alloys AZ91D and AE42 at ambient temperature, and particularly at elevated temperatures 175° C. and 200°.

As can be seen from Table 4 creep behavior the alloys of the present invention exhibit higher tensile yield strength (TYS) and higher compressive yield strength (CYS) at ambient temperature, at 175° C. and at 200° C. when compared with AZ91D alloy, and significantly higher when compared with AE42 alloy.

The greatest advantage of the alloys of this invention, as can be seen from Table 4, is their creep behavior. The values of minimum creep rate (MCR) are lower by two or three orders for the new alloys, when compared with commercial alloys AZ91D and AE42, both at 150° C. and at 200° C. For example, MCR value of an alloy according to this invention in the Example 5 is $0.80\times10^{-9}$/sec at 150° C., compared to the value $1429\times10^{-9}$ for alloy AZ91D.

Table 5 shows the effect of ageing, at 250° C. for 1 hour, on properties of new alloys. The values TYS, UTS, E, and CYS relate to 20° C. The table shows the values before and after the treatment. It can be seen that the ageing treatment improved the most of the studied parameters.

While this invention has been described in terms of some specific examples, many modifications and variations are possible. It is therefore understood that within the scope of the appended claims, the invention may be realized otherwise than as specifically described.

The invention claimed is:

1. A magnesium based alloy exhibiting a tensile yield strength (TYS) at 175° C. of at least 150 MPa, and exhibiting minimum creep rate (MCR) less than $1.7\times10^{-9}$/s at 150° C. under stress of 100 MPa consisting essentially of:

i) at least 85.4 Wt % Mg, ii) 4.7 to 7.3 wt % aluminum, iii) 0.17 to 0.60 wt % manganese, iv) 0.0 to 0.8 wt % zinc, v) 1.8 to 3.2 wt % calcium, vi) 0.3 to 2.2 wt % tin, vii) 0.0 to 0.5 wt % strontium and up to 0.004 wt % iron, up to 0.001 wt % nickel, up to 0.003 wt % copper, and up to 0.03 wt % silicon.

2. An alloy according to claim 1, which contains 5.9 to 7.2 wt % aluminum, 0.9 to 2.1 wt % tin, 2.1 to 3.1 wt % calcium, and 0.2 to 0.35 wt % manganese.

3. An alloy according to claim 1 exhibiting a marked response to aging at 250° C., wherein tensile yield strength, compressive yield strength, and creep resistance increase.

4. An alloy according to claim 1 which is beryllium free.

5. An alloy according to claim 1, which exhibits minimum creep rate less than $4.9\times10^{-9}$/s at 200° C. under stress of 55 Mpa.

6. An alloy according to claim 1, which exhibits improvements of its strength in course of temperature aging at 250° C. for 1 hour.

7. An article which is a casting of a magnesium alloy of claim 1.

8. An article of claim 7, wherein the casting is chosen from the group consisting of high-pressure die-casting, sand casting, permanent mold casting, squeeze casting, semi-solid casting, thixocasting and thixomolding.

9. An article according to claim 7, which was subjected to temperature aging at 250° C. for 1 hour.

10. An alloy according to claim 1, comprising in its structure grains of Mg—Al solid solution or Mg—Al—Sn solid solution, and an intermetallic compound chosen from $Al_2Ca$, $Al_2(Ca,Sr)$, $Al_xMn_y$, $Al_2(Ca,Sn)$ and $Al_2(Ca,Sn,Sr)$, wherein said intermetallic compounds are located at grain boundaries of said Mg—Al solid solution or Mg—Al—Sn solid solution.

11. An alloy according to claim 1 having tensile yield strength (TYS) of between 142 and 160 Mpa at 200° C.

12. An alloy according to claim 1 having compressive yield strength (CYS) of between 142 and 161 Mpa at 200° C.

* * * * *